US010059103B2

(12) United States Patent
Hamano et al.

(10) Patent No.: US 10,059,103 B2
(45) Date of Patent: Aug. 28, 2018

(54) LIQUID JET HEAD AND LIQUID JET APPARATUS

(71) Applicant: SII Printek Inc., Chiba-shi, Chiba (JP)

(72) Inventors: Yuichiro Hamano, Chiba (JP); Yutaka Hongo, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 15/591,442

(22) Filed: May 10, 2017

(65) Prior Publication Data

US 2017/0341386 A1 Nov. 30, 2017

(30) Foreign Application Priority Data

May 27, 2016 (JP) ..... 2016-106238
Dec. 27, 2016 (JP) ..... 2016-252719

(51) Int. Cl.
*B41J 2/14* (2006.01)

(52) U.S. Cl.
CPC ..... *B41J 2/1433* (2013.01); *B41J 2/14201* (2013.01); *B41J 2/14209* (2013.01); *B41J 2002/14362* (2013.01); *B41J 2002/14419* (2013.01); *B41J 2002/14491* (2013.01); *B41J 2202/08* (2013.01)

(58) Field of Classification Search
CPC ..... B41J 2/01; B41J 2/1433; B41J 2/14201; B41J 2/14209; B41J 2/14; B41J 2/14072; B41J 2/14088; B41J 2/14145; B41J 2/04531; B41J 2/14056; B41J 2/14064; B41J 2/14096; B41J 2/1606; B41J 2002/14145; B41J 2002/14185; B41J 2002/14419; B41J 2002/14491; B41J 2002/14177; B41J 2202/08
See application file for complete search history.

(56) References Cited

U.S. PATENT DOCUMENTS 6,003,971 A 12/1999 Hanks et al.
2003/0038868 A1* 2/2003 Arai ..... B41J 2/055 347/94
2005/0179724 A1* 8/2005 Salt ..... B41J 2/14209 347/40
2007/0070106 A1* 3/2007 Yasuda ..... B41J 2/155 347/13
2007/0119574 A1* 5/2007 Olesen ..... F28F 3/12 165/100
2008/0049074 A1* 2/2008 Deguchi ..... B41J 2/1433 347/65

(Continued)

FOREIGN PATENT DOCUMENTS

JP 2005-212268 A 8/2005
JP 2015-120265 A 7/2015

OTHER PUBLICATIONS

Extended European Search Report in European Application No. 17173112.8, dated Oct. 24, 2017, 4 pages.

*Primary Examiner* — Geoffrey Mruk
*Assistant Examiner* — Scott A Richmond
(74) *Attorney, Agent, or Firm* — Brinks Gilson & Lione

(57) ABSTRACT

A liquid jet head includes: a head chip including a channel to be filled with ink; a manifold that supports the head chip and includes an ink flow path communicating with the ejection channel; and a heater and a drive board that are supported on the manifold and heat ink inside the ink flow path. The ink flow path extends in a meandering manner.

11 Claims, 16 Drawing Sheets

(56) References Cited

U.S. PATENT DOCUMENTS

| | | | | |
|---|---|---|---|---|
| 2011/0017438 | A1* | 1/2011 | Huazhao | F25B 39/028 165/174 |
| 2011/0226448 | A1* | 9/2011 | Valenzuela | F28F 3/12 165/109.1 |
| 2016/0109190 | A1* | 4/2016 | Olesen | F28F 3/12 165/170 |

* cited by examiner

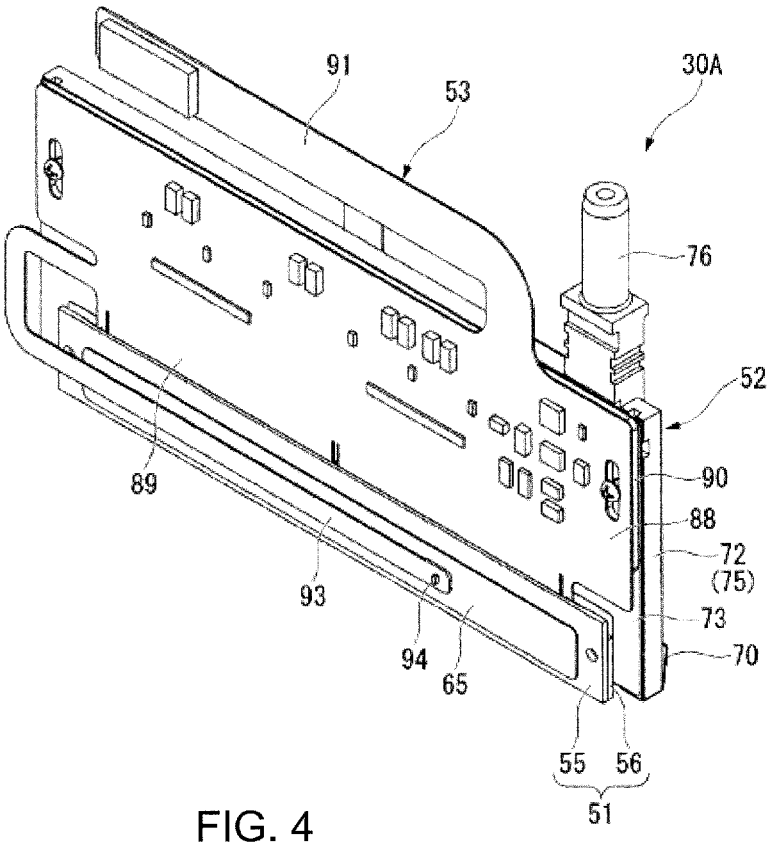
FIG. 4
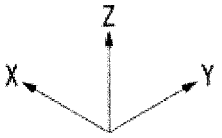

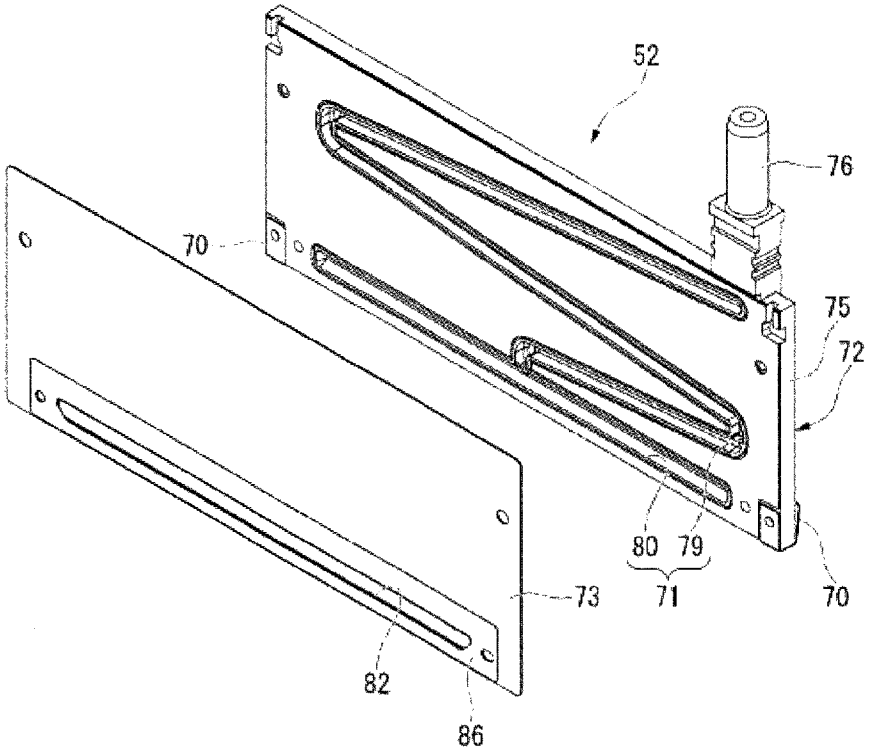
FIG. 6
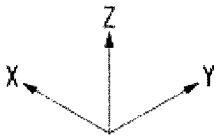

LIQUID JET HEAD AND LIQUID JET APPARATUS

RELATED APPLICATIONS

This application claims priority under 35 U.S.C. § 119 to Japanese Patent Applications No. 2016-106238 filed on May 27, 2016 and No. 2016-252719 filed on Dec. 27, 2016, , the entire content of which is hereby incorporated by reference.

BACKGROUND OF THE INVENTION

Technical Field

The present invention relates to a liquid jet head and a liquid jet apparatus.

Related Art

Conventionally, there has been an ink jet printer provided with an ink jet head as an apparatus that ejects ink in the form of liquid droplets onto a recording medium such as recording paper to record images or characters on the recording medium. For example, the ink jet head includes a plurality of head modules corresponding to respective colors which are mounted on a carriage.

The above head module includes a head chip which ejects ink, a manifold which includes an ink flow path for supplying ink to the head chip, and a drive board which drives the head chip (e.g., JP 2015-120265 A). The head chip, the manifold, and the drive board are mounted on a base member.

In JP 2015-120265 A, the base member is provided with a horizontal base which extends in a scanning direction of the ink jet head and a vertical base which stands from the horizontal base.

The head chip and the drive board are supported, for example, on the vertical base. Accordingly, heat generated in the head chip or the drive board is dissipated through the vertical base. On the other hand, the manifold is disposed on the base member at a side opposite to the vertical base across the head chip in the scanning direction of the ink jet head.

SUMMARY OF THE INVENTION

In ink jet printers, there is still room for improvement in maintaining the temperature of ink during ejection within a desired temperature range. Variations in the ink temperature during ejection result in variations in the viscosity of ink. Accordingly, the ejection amount and the ejection speed of ink are varied. As a result, a desired printing characteristic may not be obtained.

The present invention has been made in view of the above circumstances, and an object thereof is to provide a liquid jet head and a liquid jet apparatus having an excellent printing characteristic.

In order to solve the above problem, a liquid jet head according to one aspect of the present invention includes: a head chip including a channel filled with liquid; a manifold configured to support the head chip, the manifold including a liquid flow path communicating with the channel; and a heating mechanism configured to heat the liquid inside the liquid flow path, the heating mechanism being supported on the manifold. The liquid flow path extends in a meandering manner.

According to this configuration, the liquid flow path extends in a meandering manner Thus, it is possible to increase a heat transfer area between the liquid and the manifold as compared to a case in which a liquid flow path is linearly formed from the upstream end toward the downstream end. Therefore, heat of the heating mechanism can be effectively transmitted to liquid inside the liquid flow path. Accordingly, it is possible to supply liquid having a desired temperature (viscosity) to the head chip, which enables the temperature of liquid during jet to be maintained within a desired range. As a result, it is possible to reduce variations in the jet amount and the jet speed of liquid and thereby obtain an excellent printing characteristic.

In the above aspect, the heating mechanism may be a heater.

According to the above aspect, liquid flowing through the liquid flow path is heated also by the heater. Thus, it is possible to reliably supply liquid having a desired temperature to the head chip.

In the above aspect, the heating mechanism may be a drive board electrically connected to the head chip.

According to the above aspect, liquid can be heated using exhaust heat from the drive board. Accordingly, it is possible to reduce power consumption required for heating liquid as compared to a case in which liquid is heated only by the heater.

Further, heat generated in the drive board is effectively dissipated to the manifold and liquid flowing through the liquid flow path. Thus, it is possible to prevent the temperature of the drive board from becoming high.

In the above aspect, a coating having corrosion resistance to the liquid may be formed on the manifold, at least on an inner face of the liquid flow path.

According to the above aspect, since the coating having corrosion resistance is formed on the inner face of the liquid flow path, it is possible to reduce corrosion of the manifold caused by ink and thereby improve durability.

In the above aspect, the liquid flow path may include: a main flow path; and a liquid reservoir configured to retain liquid, the liquid reservoir communicating with the main flow path.

According to the above aspect, liquid flowing through the liquid flow path is temporarily retained in the liquid reservoir. Thus, a sufficient time for heating liquid can be ensured. Accordingly, it is possible to supply liquid having a desired temperature (viscosity) to the head chip, which enables the temperature of liquid during jet to be maintained within a desired range. As a result, it is possible to reduce variations in the jet amount and the jet speed of liquid and thereby obtain an excellent printing characteristic.

In the above aspect, the manifold may include a flow path member including a first face configured to support the head chip, the liquid flow path may include a communication opening that penetrates the flow path member in a normal direction of the first face and collectively communicates with a plurality of the channels, and the communication opening may be blocked by a film member disposed on a second face facing opposite to the first face of the flow path member in the normal direction.

According to the above aspect, the communication opening penetrates the flow path member in the normal direction. Thus, it is possible to easily ensure a sufficient capacity of the communication opening while downsizing the manifold in the normal direction of the first face of the manifold as compared to a case in which the liquid flow path is formed in a groove shape. Ensuring a sufficient capacity of the communication opening makes it easy to absorb pressure fluctuations in the head chip inside the communication opening. Thus, it is possible to reduce crosstalk (a phenomenon in which pressure fluctuations in one channel are transmitted to another channel through the communication opening).

In the above aspect, the film member may have flexibility.

According to the above aspect, the film member is flexurally deformed in response to pressure fluctuations inside the head chip. This makes it possible to absorb the pressure fluctuations inside the head chip. For example, the pressure inside the channel is momentarily reduced by a reduction in the capacity of the channel caused by jet of liquid. Accordingly, the pressure fluctuations inside the channel are transmitted to the communication opening as pressure waves, and the film member is flexurally deformed. That is, the film member is flexurally deformed so as to reduce the capacity of the communication opening. Accordingly, the pressure fluctuations which occur inside the channel can be absorbed by the communication opening. Further, it is also possible to reduce the crosstalk by absorbing the pressure fluctuations by the film member. As a result, the printing characteristic can be improved.

In the above aspect, the manifold may include a film holder configured to hold the film member in the normal direction between the film holder and the flow path member.

According to the above aspect, it is possible to reduce come-off and damage of the film member and thereby improve durability by holding the film member in the normal direction between the film holder and the flow path member.

In the above aspect, the film holder may include a clearance hole configured to allow flexural deformation of the film member, the clearance hole being formed at a position overlapping the communication opening in the normal direction, and a part of an opening edge of the clearance hole may be provided with a chamfered portion, the opening edge facing the film member in the normal direction.

According to the above aspect, the chamfered portion is formed on the part of the opening edge of the clearance hold which faces the film member in the normal direction. Thus, it is possible to reduce interference between the film member and the corner of the film holder when the film member is flexurally deformed. As a result, it is possible to reduce damage of the film member and thereby improve durability.

In the above aspect, the second face of the flow path member may include a housing recess configured to house the film member and the film holder, the housing recess being recessed in the normal direction.

According to the above aspect, since the housing recess is formed on the flow path member, the housing recess can be used as a guide which is used when the film member and the film holder are attached to the flow path member. This makes it possible to improve the positioning accuracy and the assembling efficiency of the film member and the film holder.

Further, it is possible to reduce a projecting amount of the film member and the film holder from the second face of the flow path member. Thus, the manifold can be downsized in the normal direction of the first face of the manifold.

A liquid jet apparatus according to one aspect of the present invention includes the liquid jet head according to the above aspect.

According to the above aspect, it is possible to provide the liquid jet apparatus having an excellent printing characteristic.

According to one aspect of the present invention, it is possible to provide the liquid jet head and the liquid jet apparatus an excellent printing characteristic.

BRIEF DESCRIPTION OF THE DRAWINGS

FIG. 4 is a perspective view of a first head module according to the first embodiment;

FIG. 6 is an exploded perspective view of a manifold according to the first embodiment;

DETAILED DESCRIPTION OF THE PREFERRED EMBODIMENTS

Figure 1:
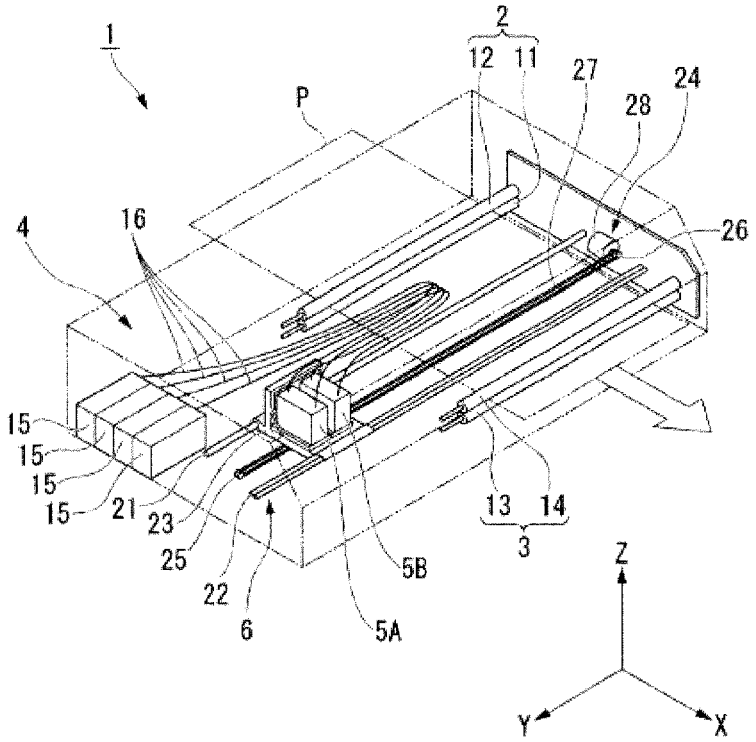
FIG. 1 is a schematic configuration diagram of an ink jet printer according to a first embodiment.

Hereinbelow, an embodiment according to the present invention will be described with reference to the drawings. In the following description, an ink jet printer (hereinbelow, merely referred to as the printer) which performs recording on a recording medium using ink (liquid) will be described as an example. Note that, in the drawings used in the following description, the scale of each member is appropriately changed so as to allow each member to have a recognizable size.

(First Embodiment)

[Printer]

FIG. 1 is a schematic configuration diagram of a printer 1.

As illustrated in FIG. 1, the printer 1 of the present embodiment is provided with a pair of conveyance mechanisms 2, 3, an ink supply mechanism 4, ink jet heads 5A, 5B, and a scanning mechanism 6. In the following description, an X, Y, Z orthogonal coordinate system is used as needed. In this case, an X direction corresponds to a conveyance direction (sub-scanning direction) of a recording medium P (e.g., paper). A Y direction (normal direction) corresponds to a scanning direction (main-scanning direction) of the scanning mechanism 6. A Z direction indicates a height direction which is perpendicular to the X direction and the Y direction. In the following description, in the X direction, the Y direction, and the Z direction, an arrow direction in the drawings is defined as a plus (+) direction, and a direction opposite to the arrow is defined as a minus (−) direction.

The conveyance mechanisms 2, 3 convey the recording medium P in the +X direction. Specifically, the conveyance mechanism 2 is provided with a grid roller 11 which extends in the Y direction, a pinch roller 12 which extends parallel to the grid roller 11, and a drive mechanism (not illustrated) such as a motor which axially rotates the grid roller 11. Similarly, the conveyance mechanism 3 is provided with a grid roller 13 which extends in the Y direction, a pinch roller 14 which extends parallel to the grid roller 13, and a drive mechanism (not illustrated) which axially rotates the grid roller 13.

The ink supply mechanism 4 is provided with an ink tank 15 which stores ink therein and an ink tube 16 which connects the ink tank 15 to the ink jet heads 5A, 5B.

In the present embodiment, a plurality of ink tanks 15 are arranged side by side in the X direction. The ink tanks 15 store therein respective four colors of ink, for example, yellow ink, magenta ink, cyan ink, and black ink.

The ink tube 16 is, for example, a flexible hose which has flexibility. The ink tube 16 connects each of the ink tanks 15 to a corresponding one of the ink jet heads 5A, 5B.

The scanning mechanism 6 moves the ink jet heads 5A, 5B back and forth in the Y direction. Specifically, the scanning mechanism 6 is provided with a pair of guide rails 21, 22 which extend in the Y direction, a carriage 23 which is movably supported on the pair of guide rails 21, 22, and a drive mechanism 24 which moves the carriage 23 in the Y direction.

The drive mechanism 24 is disposed between the guide rails 21, 22 in the X direction. The drive mechanism 24 is provided with a pair of pulleys 25, 26 which are disposed at an interval in the Y direction, an endless belt 27 which is wound around the pair of pulleys 25, 26, and a drive motor 28 which drives the pulley 25 to rotate.

The carriage 23 is coupled to the endless belt 27. The ink jet heads 5A, 5B are mounted on the carriage 23 side by side in the Y direction. Each of the ink jet heads 5A, 5B is configured to eject two colors of ink. Thus, in the printer 1 of the present embodiment, the ink jet head 5A ejects two colors of ink different from two colors of ink ejected by the ink jet head 5B, so that four colors of ink: yellow ink, magenta ink, cyan ink, and black ink can be ejected.

<Ink Jet Head>

Figure 2:
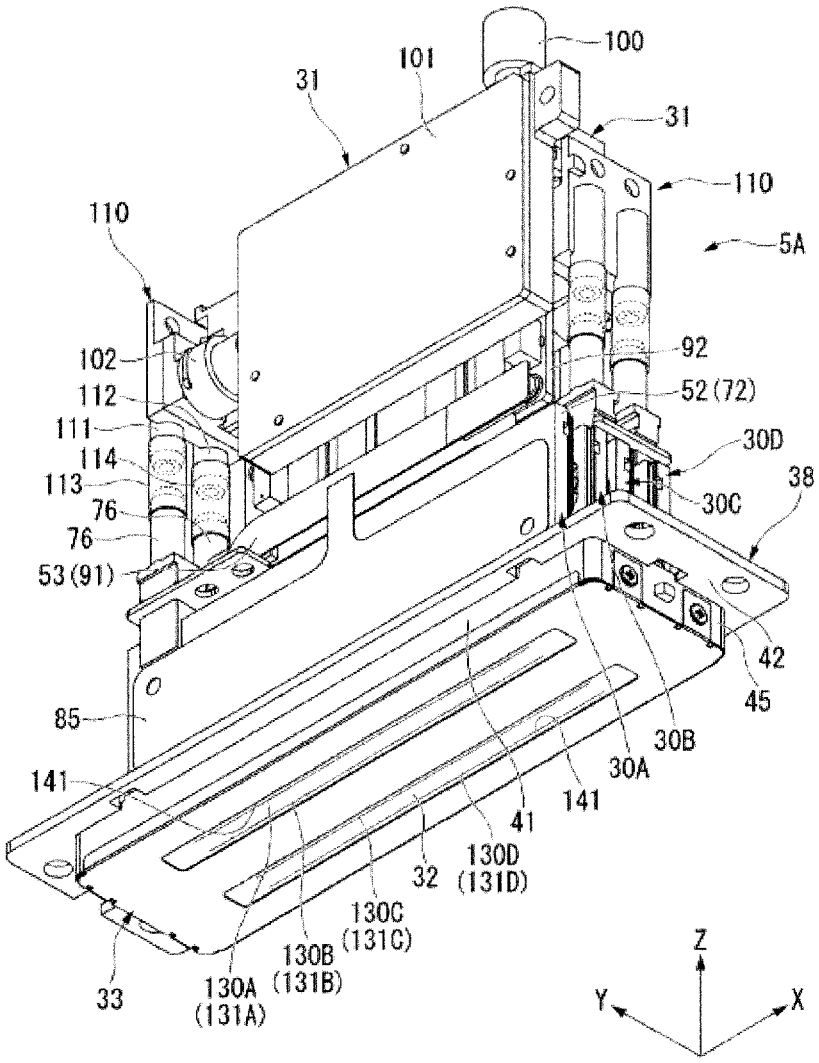
FIG. 2 is a perspective view of the ink jet head according to the first embodiment.

FIG. 2 is a perspective view of the ink jet head 5A. The ink jet heads 5A, 5B have the same configuration except the colors of ink supplied thereto. Thus, hereinbelow, the ink jet head 5A will be described, and description for the ink jet head 5B will be omitted.

As illustrated in FIG. 2, the ink jet head 5A of the present embodiment includes head modules 30A to 30D, a damper 31, a nozzle plate (jet hole plate) 32, and a nozzle guard (jet hole guard) 33 all of which are mounted on a base member 38. In FIG. 2, a cover which covers the head modules 30A to 30D and the damper 31 is not illustrated.

(Base Member)

Figure 3:
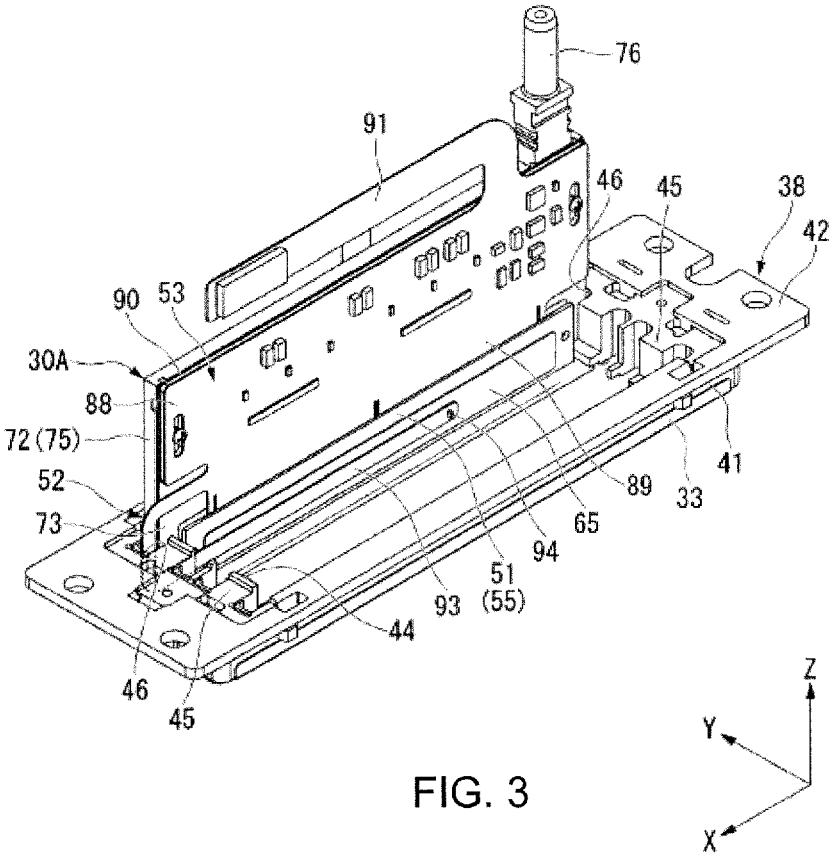
FIG. 3 is a perspective view illustrating a state in which a part of the ink jet head according to the first embodiment is detached.

FIG. 3 is a perspective view illustrating a state in which a part of the ink jet head 5A is detached.

As illustrated in FIG. 3, the base member 38 is formed in a plate-like shape whose thickness direction corresponds to the Z direction and whose longitudinal direction corresponds to the X direction. The base member 38 includes a module holding portion 41 which holds each of the head modules 30A to 30D and a carriage fixing portion 42 for fixing the base member 38 to the carriage 23 (refer to FIG. 1). In the present embodiment, the base member 38 is integrally formed of a metal material.

The module holding portion 41 is formed in a frame shape in plan view viewed from the Z direction. That is, an attachment opening 44 which penetrates the base member 38 in the Z direction is formed on a central part of the module holding portion 41 in an XY plane. The module holding portion 41 includes a pair of short side parts 45 which are located at opposite sides in the X direction and include insertion grooves 46. In the present embodiment, insertion grooves 46 that are formed on the respective short side parts 45 and opposed to each other in the X direction are defined as one set, and a plurality of sets (e.g., four sets) of insertion grooves 46 are formed at intervals in the Y direction.

Each of the insertion grooves 46 is recessed in the X direction with respect to the inner peripheral face of the short side part 45 and penetrates the short side part 45 in the Z direction. That is, the insertion grooves 46 communicate with the attachment opening 44. Each of the head modules 30A to 30D is insertable into a corresponding set of insertion grooves 46 which are opposed to each other in the X direction. In each set of insertion grooves 46, a first biasing member (not illustrated) is disposed on an inner face of one of the insertion grooves 46. The first biasing member biases a corresponding one of the head modules 30A to 30D to one side in the X direction toward the other insertion groove 46. In the present embodiment, the first biasing member is formed in a flat spring shape.

The carriage fixing portion 42 projects on the XY plane from a +Z direction end of the module holding portion 41. The carriage fixing portion 42 includes an attachment hole for attaching the base member 38 to the carriage 23 (refer to FIG. 1).

(Head Module)

As illustrated in FIG. 2, each of the head modules 30A to 30D is capable of ejecting ink supplied from the ink tank 15 (refer to FIG. 1) toward the recording medium P. The head modules 30A to 30D are mounted on the base member 38 at intervals in the Y direction. In the present embodiment, four head modules including the first head module 30A, the second head module 30B, the third head module 30C, and the fourth head module 30D are mounted on the base member 38.

In the ink jet head 5A of the present embodiment, each two of the four head modules 30A to 30D eject one color of ink. Specifically, the first head module 30A and the second head module 30B are configured to eject the same color of ink, and the third head module 30C and the fourth head module 30D are configured to eject the same color of ink. Note that the number of head modules 30A to 30D mounted on the base member 38 and the types of ink ejected from the head modules 30A to 30D can be appropriately changed. The head modules 30A to 30D have corresponding configurations to each other. Thus, hereinbelow, the first head module 30A will be described as an example.

FIG. 4 is a perspective view of the first head module 30A.

As illustrated in FIG. 4, the first head module 30A is mainly provided with a head chip 51, a manifold 52, and a drive board (heating mechanism) 53.

(Head Chip)

Figure 5:
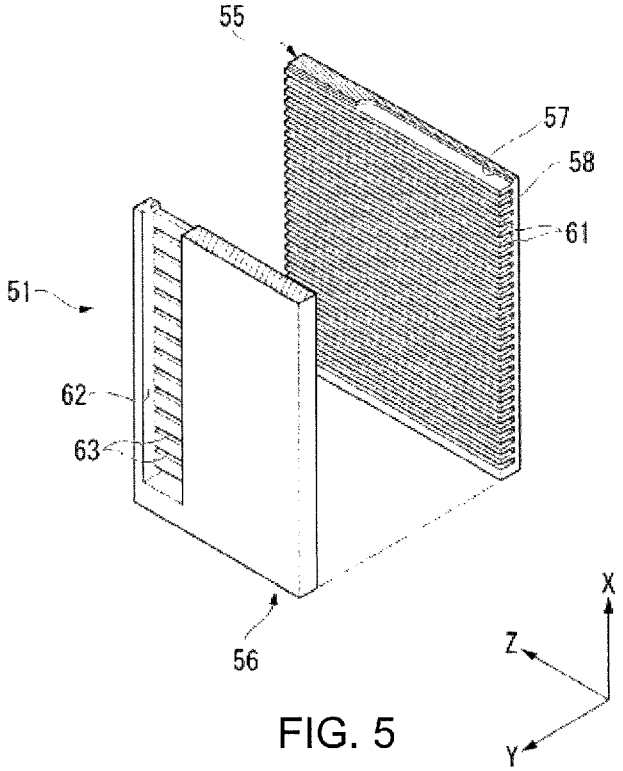
FIG. 5 is an exploded perspective view of a head chip according to the first embodiment.

FIG. 5 is an exploded perspective view of the head chip 51.

As illustrated in FIG. 5, the head chip 51 is an edge shoot type head chip which ejects ink from an end in an extending direction (Z direction) of an ejection channel 57 (described below). Specifically, the head chip 51 includes an actuator plate 55 and a cover plate 56 which are stacked in the Y direction.

The actuator plate 55 is a monopole substrate whose polarization direction is set at one direction along the thickness direction (Y direction). For example, a ceramic substrate which is made of lead zirconate titanate (PZT) is suitably used as the actuator plate 55. The actuator plate 55 may be formed by laminating two piezoelectric substrates whose polarization directions differ from each other in the Y direction (chevron type).

The actuator plate 55 includes a plurality of channels 57, 58 which are formed on a face facing the +Y direction (hereinbelow, referred to as the "front face") and arranged side by side at intervals in the X direction. Each of the channels 57, 58 is linearly formed along the Z direction. Each of the channels 57, 58 is open on a −Z direction end face of the actuator plate 55 and ends on a +Z direction end face of the actuator plate 55. Each of the channels 57, 58 may be inclined with respect to the Z direction.

The channels 57, 58 are classified into the ejection channels 57 which are filled with ink and the non-ejection channels 58 which are not filled with ink. The ejection channels 57 and the non-ejection channels 58 are alternately arranged side by side in the X direction. The channels 57, 58 are partitioned by drive walls 61 of the actuator plate 55 in the X direction. Drive electrodes (not illustrated) are formed on inner faces of the channels 57, 58.

The cover plate 56 is formed in a rectangular shape in front view viewed from the Y direction. The cover plate 56 is joined to the front face of the actuator plate 55 with the +Z direction end of the actuator plate 55 projecting therefrom.

The cover plate 56 includes a common ink chamber 62 which is formed on a face facing the +Y direction (hereinbelow, referred to as the "front face") and a plurality of slits 63 which are formed on a face facing the −Y direction (hereinbelow, referred to as the "back face").

The common ink chamber 62 is formed at a position corresponding to a +Z direction end of each of the ejection channels 57 in the Z direction. The common ink chamber 62 is recessed from the front face of the cover plate 56 toward the −Y direction and extends in the X direction. Ink flows into the common ink chamber 62 through the manifold 52.

The slits 63 are formed in the common ink chamber 62 at positions facing the respective ejection channels 57 in the Y direction. The slits 63 allow the common ink chamber 62 and the respective ejection channels 57 to communicate with each other. On the other hand, the non-ejection channels 58 do not communicate with the common ink chamber 62.

As illustrated in FIG. 4, a heat transfer plate 65 is attached to a face facing the −Y direction (hereinbelow, referred to as the "back face") of the actuator plate 55. The heat transfer plate 65 is formed of a material having a high thermal conductivity (e.g., aluminum). The heat transfer plate 65 covers the entire channels 57, 58 on the back face of the actuator plate 55. The size and the position of the heat transfer plate 65 can be appropriately changed.

(Manifold)

As illustrated in FIG. 3, the manifold 52 includes an ink flow path 71 (refer to FIG. 6) through which ink flows toward the head chip 51. The manifold 52 is formed in a plate-like shape whose thickness direction corresponds to the Y direction as a whole. The manifold 52 is inserted into one set of insertion grooves 46 which are opposed to each other in the X direction so as to be held in a standing state in the +Z direction on the base member 38. As illustrated in FIG. 4, second biasing members 70 are disposed on opposite ends in the X direction at a −Z direction end of the manifold 52. Each of the second biasing members 70 is interposed between the inner face of the insertion groove 46 and the manifold 52 inside the insertion groove 46 to bias the first head module 30A in the −Y direction. In the present embodiment, the second biasing member 70 is formed in a flat spring shape.

FIG. 6 is an exploded perspective view of the manifold 52.

As illustrated in FIG. 6, the manifold 52 includes a flow path member 72 and a flow path cover 73 which is stacked on the flow path member 72 in the Y direction.

The flow path member 72 is integrally formed of a material having a high thermal conductivity. In the present embodiment, a metal material (e.g., aluminum) is suitably used as the material of the flow path member 72.

The flow path member 72 is provided with a flow path plate 75 and an inflow port 76.

The flow path plate 75 is formed in a rectangular plate-like shape whose thickness direction corresponds to the Y direction. The flow path plate 75 includes the ink flow path 71 which is formed on a face facing the −Y direction. The ink flow path 71 is formed in a groove shape recessed in the +Y direction. Specifically, the ink flow path 71 includes a meandering portion 79 and a communication portion 80.

The meandering portion 79 extends in the Z direction while meandering in the X direction. A +Z direction end of the meandering portion 79 communicates with the inside of the inflow port 76. On the other hand, a −Z direction end of the meandering portion 79 communicates with the communication portion 80 at a central part in the X direction of the flow path plate 75. A meandering direction of the meandering portion 79 can be appropriately changed to any direction that makes the meandering portion 79 longer than a straight line connecting a communicating part between the meandering portion 79 and the inflow port 76 to a communicating part between the meandering portion 79 and the communication portion 80. For example, the meandering portion 79 may extend in the X direction while meandering in the Z direction.

The communication portion 80 extends in the X direction at a −Z direction end of the flow path plate 75. The communication portion 80 has the same shape as the common ink chamber 62 in front view viewed from the Y direction.

In the first head module 30A, the inflow port 76 is disposed at a −X direction end on a +Z direction end face of the flow path plate 75. The inflow port 76 is formed in a tubular shape projecting toward the +Z direction from the flow path plate 75. A −Z direction end of the inflow port 76 communicates with the meandering portion 79. A coating having corrosion resistance (ink resistance) is preferably formed on the manifold 52 at least in a part that makes contact with ink (the inner face of the ink flow path 71 and the inner face of the inflow port 76). For example, when solvent ink is used, a surface treatment such as nickel plating or anodizing on aluminum can be suitably selected as the coating. The coating may be applied to the entire manifold 52.

The flow path cover 73 is formed in a rectangular plate-like shape which has the same outer shape as the flow path plate 75 in front view viewed from the Y direction and has a Y-direction thickness thinner than the flow path plate 75. The flow path cover 73 is fixed to the face facing the −Y direction of the flow path plate 75 and blocks the ink flow path 71 from the −Y direction. A communication hole 82 which opens the communication portion 80 is formed on the flow path cover 73 at a position overlapping the communication portion 80 in the Y direction. The communication hole 82 has the same shape as the communication portion 80 in front view viewed from the Y direction.

In the present embodiment, the flow path cover 73 is formed of a metal material (e.g., stainless steel) having a high thermal conductivity. In the present embodiment, the groove-shaped ink flow path 71 is formed only on the flow path member 72. However, the present invention is not limited only to this configuration. It is only required that an ink flow path be formed on at least either the flow path member 72 or the flow path cover 73. In this case, for example, grooves may be formed on both the flow path member 72 and the flow path cover 73, and the grooves of the flow path member 72 and the flow path cover 73 may be joined to form an ink flow path.

The flow path cover 73 includes an insulating sheet 86 which is disposed on a face facing the −Y direction. The insulating sheet 86 is formed in a frame shape in front view viewed from the Y direction. The insulating sheet 86 surrounds the periphery of the communication hole 82 on the face facing the −Y direction of the flow path cover 73. The insulating sheet 86 is fixed to the face facing the −Y direction of the flow path cover 73 with, for example, an adhesive. In the present embodiment, for example, polyimide is suitably used as the insulating sheet 86. The material of the insulating sheet 86 can be appropriately changed to any material (e.g., a resin material or a rubber material) that has a characteristic capable of sufficiently reducing stray capacitance (e.g., a material having a low dielectric constant or a material capable of reducing a dielectric constant with a tiny space distance) or an ink resistance (elution resistance) and that is relatively soft (has a small Young's modulus).

As illustrated in FIGS. 4 and 6, the head chip 51 is fixed on the face facing the −Y direction (a first face facing a third direction) of the flow path cover 73 with the insulating sheet 86 interposed therebetween. Specifically, the head chip 51 is fixed to the insulating sheet 86 with, for example, an adhesive with the front face (the face facing the manifold 52) of the cover plate 56 facing the insulating sheet 86. In this case, the common ink chamber 62 of the cover plate 56 communicates with the communication portion 80 through the communication hole 82. Accordingly, ink flowing through the ink flow path 71 is supplied to the head chip 51. The head chip 51 projects in the −Z direction with respect to the manifold 52 when fixed to the manifold 52. In the example illustrated in FIG. 4, the length in the X direction of the head chip 51 is shorter than the length in the X direction of the manifold 52.

As illustrated in FIG. 2, a heater (heating mechanism) 85 is disposed on a face facing the +Y direction (a second face facing the third direction) of the flow path member 72 (the flow path plate 75). The heater 85 heats the inside of the ink flow path 71 through the flow path member 72 to keep ink flowing through the ink flow path 71 within a predetermined temperature range (keep the ink warm).

As illustrated in FIG. 4, the drive board 53 is a flexible printed circuit board and includes a wiring pattern and various electronic components which are mounted on a base film. The drive board 53 includes a module control portion 88 which is supported on the manifold 52 and a chip connecting portion 89 which connects the module control portion 88 to the head chip 51. In the drive board 53, for example, a rigid board may be used as the module control portion 88 as long as at least the chip connecting portion 89 is composed of a flexible board.

The module control portion 88 is formed in a rectangular shape in front view viewed from the Y direction. An electronic component such as a driver IC is mounted on the module control portion 88. The module control portion 88 is fixed to the manifold 52 with a support plate 90 interposed therebetween in a part located in the +Z direction with respect to the head chip 51 on the face facing the −Y direction of the flow path cover 73. The support plate 90 is formed of a material (e.g., a metal material) having a high thermal conductivity. The support plate 90 may not be provided. That is, the module control portion 88 may be directly fixed to the manifold 52.

As illustrated in FIG. 2, the drive board 53 is electrically connected to an external connection board 92 through a lead-out portion 91 which is led out from the module control portion 88 in the +Z direction. The external connection board 92 relays a control signal and drive voltage output from a main control board (not illustrated) which is mounted on the printer 1 to each of the head modules 30A to 30D (driver IC). The drive board 53 drives the head chip 51 on the basis of the control signal and the drive voltage relayed by the external connection board 92.

As illustrated in FIG. 4, the chip connecting portion 89 extends in the −Z direction from the module control portion 88 with a clearance left in the Y direction with respect to the flow path cover 73. A −Z direction end of the chip connecting portion 89 is fixed to the +Z direction end of the actuator plate 55 by, for example, pressure bonding. Accordingly, the drive board 53 and the drive electrodes of the head chip 51 are electrically connected.

The drive board 53 is provided with a sensor connecting portion 93 which is led out from a +X direction end of the module control portion 88. The sensor connecting portion 93 extends up to a position that overlaps the heat transfer plate 65 when viewed from the Y direction. A temperature sensor 94 (e.g., a thermistor) which detects an ink temperature inside the ejection channels 57 is mounted on the tip of the sensor connecting portion 93. The temperature sensor 94 is disposed on the back face of the actuator plate 55 with the heat transfer plate 65 interposed therebetween.

As illustrated in FIG. 3, the first head module 30A is inserted in the attachment opening 44 with the manifold 52 inserted in the corresponding set of insertion grooves 46 as described above. In this case, the first head module 30A is held on the base member 38 in such a manner that the head chip 51 faces the −Y direction and a −Z direction end face of the head chip 51 is flush with a −Z direction end face of the base member 38 (the module holding portion 41).

As illustrated in FIGS. 2 and 3, the second head module 30B is inserted in a set of insertion grooves 46 that is adjacent, in the −Y direction, to the set of insertion grooves 46 in which the manifold 52 of the first head module 30A is inserted and, in this state, inserted in the attachment opening 44. In this case, the second head module 30B is held on the base member 38 with the head chip 51 thereof facing the head chip 51 of the first head module 30A in the Y direction. The inflow port 76 of the first head module 30A and the inflow port 76 of the second head module 30B are arranged at the same position in the X direction.

An array pitch of the ejection channels 57 on the head chip 51 of the second head module 30B is shifted by a half pitch from an array pitch of the ejection channels 57 on the head chip 51 of the first head module 30A (a staggered form). Accordingly, the head chip 51 of the first head module 30A and the head chip 51 of the second head module 30B eject one color of ink in corporation with each other to enable high-density recording of characters or images recorded on the recording medium P. In the first head module 30A and the second head module 30B, the array pitch of the ejection channels 57 of the head chip 51 can be appropriately changed.

As illustrated in FIG. 2, the third head module 30C and the fourth head module 30D are held on the base member 38 with their head chips 51 facing each other in the same manner as the first head module 30A and the second head module 30B. Each of the head modules 30A to 30D is fixed to the base member 38 through a stay (not illustrated) which is provided in a standing manner in the +Z direction from the base member 38. The inflow ports 76 of the third head module 30C and the fourth head module 30D are located at a side opposite to the inflow ports 76 of the first head module 30A and the second head module 30B in the X direction (at a +X direction end of the flow path plate 75).

(Damper)

The damper 31 is provided corresponding to each color of ink in the +Z direction with respect to the head modules 30A to 30D. That is, in the present embodiment, one damper 31 is provided for two head modules (e.g., the head modules 30A, 30B). The dampers 31 are arranged side by side in the Y direction. The dampers 31 have the same configuration except the colors of ink supplied thereto. Thus, hereinbelow, one of the dampers 31 (the damper for the head modules 30A, 30B) will be described, and description for the other damper 31 will be omitted.

The damper 31 is attached in the +Z direction with respect to the head modules 30A, 30B through a stay (not illustrated) which is fixed to the base member 38. The damper 31 includes an inlet port 100, a pressure buffer 101, and an outlet port 102. The damper 31 may be separately provided from the ink jet head 5A.

The inlet port 100 is formed in a tubular shape projecting in the +Z direction from the pressure buffer 101. The ink tube 16 (refer to FIG. 1) described above is connected to the inlet port 100. Ink inside the ink tank 15 flows into the inlet port 100 through the ink tube 16.

The pressure buffer 101 is formed in a box shape. The pressure buffer 101 stores a movable film inside thereof. The pressure buffer 101 is disposed between the ink tank 15 (FIG. 1) and the head modules 30A, 30B to absorb pressure fluctuations of ink supplied to the damper 31 through the inlet port 100.

The outlet port 102 is formed in a tubular shape projecting in the −X direction from the pressure buffer 101. Ink discharged from the pressure buffer 101 flows into the outlet port 102.

A filter unit 110 is connected to the outlet port 102. The filter unit 110 stores a filter (not illustrated) therein. The filter unit 110 removes air bubbles and foreign substances contained in ink discharged from the damper 31 by the filter. The filter unit 110 includes branch portions 111, 112 which divide ink discharged from the damper 31 into two branches. The branch portion 111 is connected to the inflow port 76 of the first head module 30A through a connection tube 113. The branch portion 112 is connected to the inflow port 76 of the second head module 30B through a connection tube 114. The filter unit 110 is fixed to the base member 38 through a stay (not illustrated). The external connection board 92 described above is disposed between the dampers 31 which are opposed to each other in the Y direction.

Figure 7:
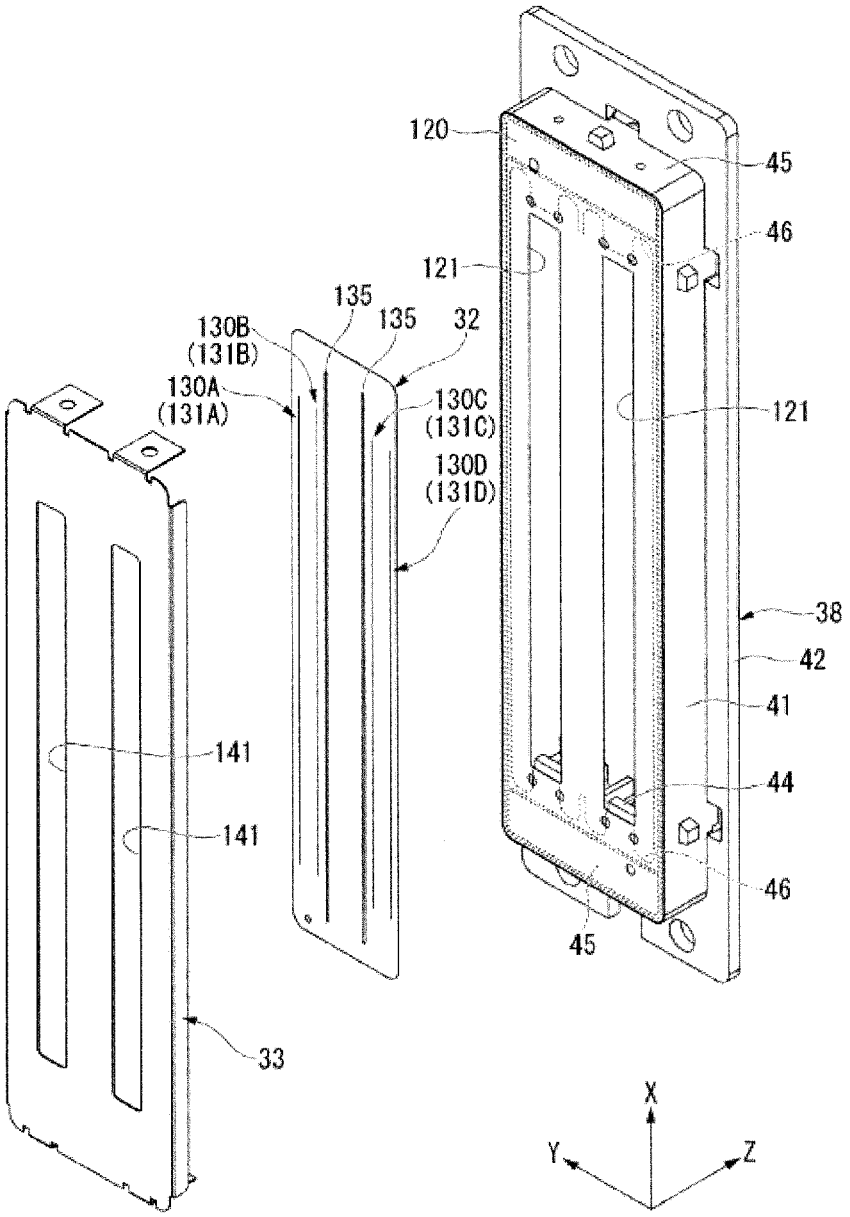
FIG. 7 is an exploded perspective view of a base member, a nozzle plate, and a nozzle guard according to the first embodiment.

FIG. 7 is an exploded perspective view of the base member 38, the nozzle plate 32, and the nozzle guard 33.

As illustrated in FIG. 7, a spacer 120 is fixed to the −Z direction end face (plate placement face) of the module holding portion 41 in the above base member 38. The spacer 120 is formed of polyimide or SUS. The spacer 120 is adhered to the −Z direction end face of the module holding portion 41 using a soft adhesive. A silicone adhesive (e.g., 1211 manufactured by ThreeBond Holdings Co., Ltd) is suitably used as the soft adhesive.

The spacer 120 covers the −Z direction end face of the module holding portion 41 from the −Z direction. The spacer 120 includes a spacer opening 121. The spacer opening 121 is formed at a position that overlaps the head chip 51 of each of the head modules 30A to 30D when viewed from the Z direction and exposes the head chip 51 in the −Z direction. In the present embodiment, the spacer opening 121 collectively exposes the head chips 51 for each color (e.g., the head chips 51 of the first head modules 30A and the second head module 30B). The spacer opening 121 may collectively expose the head chips 51 of the respective head modules 30A to 30D, or may individually expose each of the head chips 51.

(Nozzle Plate)

The nozzle plate 32 is formed of a resin material such as polyimide. A +Z direction end face (the face facing the base member 38) of the nozzle plate 32 is fixed to the spacer 120 and the −Z direction end faces of the head chips 51 with a hard adhesive. The hard adhesive is formed of, for example, a material that is harder in Shore hardness than the soft adhesive described above. An epoxy adhesive (e.g., 931-1T1N1 manufactured by Henkel Ablestik Japan Ltd.) is preferably used as such a material. The nozzle plate 32 may be directly adhered to the base member 38 using a soft adhesive.

As illustrated in FIGS. 2 and 7, the nozzle plate 32 collectively covers the head chips 51 of the respective head modules 30A to 30D from the −Z direction. The nozzle plate 32 includes a plurality of nozzle arrays (first to fourth nozzle arrays 130A to 130D) each of which extends in the X direction. The nozzle arrays are formed at intervals in the Y direction.

Each of the nozzle arrays (jet hole arrays) 130A to 130D is formed on the nozzle plate 32 at a position facing the head chip 51 of a corresponding one of the head modules 30A to 30D in the Z direction.

Figure 8:
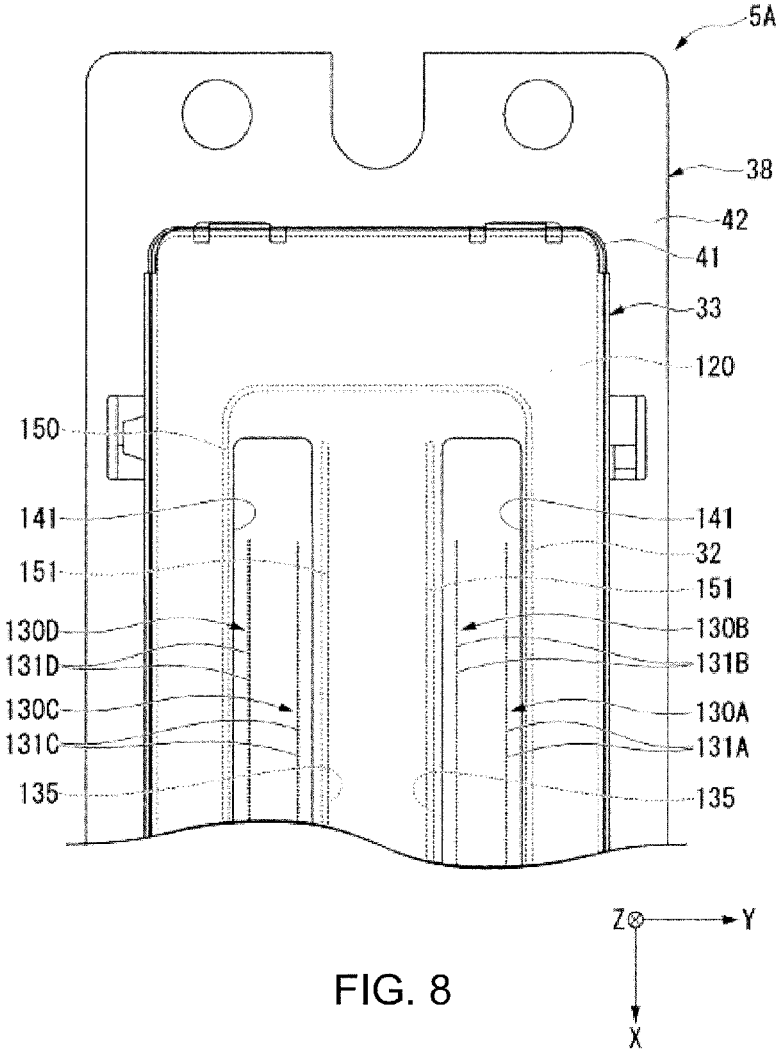
FIG. 8 is a partial bottom view of the ink jet head according to the first embodiment viewed from a −Z direction.

FIG. 8 is a partial bottom view of the ink jet head 5A viewed from the −Z direction.

As illustrated in FIG. 8, the nozzle arrays 130A to 130D include nozzle holes (first to fourth nozzle holes 131A to 131D) each of which penetrates the nozzle plate 32 in the Z direction. For example, the first nozzle holes (jet holes) 131A are formed on the nozzle plate 32 at positions facing the respective ejection channels 57 of the head chip 51 in the first head module 30A in the Z direction. That is, the plurality of first nozzle holes 131A are linearly formed at intervals in the X direction to constitute the first nozzle array 130A.

Similarly to the first nozzle holes 131A, the second nozzle holes 131B, the third nozzle holes 131C, and the fourth nozzle holes 131D are formed on the nozzle plate 32 at positions facing the ejection channels 57 of the head chips 51 in the respective head modules 30B to 30D in the Z direction.

As illustrated in FIG. 7, a slit 135 which penetrates the nozzle plate 32 in the Z direction is formed in a part of the nozzle plate 32 located between the second nozzle array 130B and the third nozzle array 130C in the Y direction. In the present embodiment, two slits 135 are formed at an interval in the Y direction. The slits 135 extend parallel to the nozzle arrays 130A to 130D along the X direction. The length in the X direction of the slit 135 is longer than the nozzle arrays 130A to 130D. The length of the slit 135 can be appropriately changed to any length shorter than the length in the X direction of the nozzle plate 32. The number of slits 135 is not limited to two, and can be appropriately changed.

The material of the nozzle plate 32 is not limited to a resin material. The nozzle plate 32 may be formed of a metal material (e.g., stainless steel), or may be a laminated structure of a resin material and a metal material. Note that the nozzle plate 32 is preferably made of a material having a thermal expansion coefficient equivalent to the spacer 120. A liquid repellent treatment is applied to a −Z direction end face of the nozzle plate 32. In the present embodiment, the single nozzle plate 32 collectively covers the head modules 30A to 30D. However, the present invention is not limited to this configuration. A plurality of nozzle plates 32 may individually cover the respective head modules 30A to 30D. The liquid repellent treatment may not be applied to the nozzle plate 32.

(Nozzle Guard)

The nozzle guard 33 is formed, for example, by pressing a plate material such as stainless steel. The nozzle guard 33 covers the module holding portion 41 from the −Z direction with the nozzle plate 32 and the spacer 120 interposed therebetween.

The nozzle guard 33 includes an exposure hole 141 which is formed at a position facing the nozzle arrays 130A to 130D in the Z direction and exposes the nozzle arrays 130A to 130D to the outside. The exposure hole 141 penetrates the nozzle guard 33 in the Z direction and is formed in a slit-like shape extending in the X direction. In the present embodiment, two exposure holes 141 are formed at an interval in the Y direction corresponding to the nozzle arrays 130A, 130B ejecting the same color of ink and the nozzle arrays 130C, 130D ejecting the same color of ink. That is, one of the exposure holes 141 exposes the first nozzle array 130A and the second nozzle array 130B to the outside. The other exposure hole 141 exposes the third nozzle array 130C and the fourth nozzle array 130D to the outside.

As illustrated in FIG. 8, the nozzle guard 33 is fixed to the spacer 120 with, for example, an adhesive. Specifically, the nozzle guard 33 is adhered to a part of the spacer 120 that is located on the outer side with respect to the nozzle plate 32 in plan view viewed from the Z direction (hereinbelow, referred to as a "first adhesion region 150"). The first adhesion region 150 is set to a frame shape surrounding the entire periphery of the nozzle plate 32. The first adhesion region 150 may be adhered to the outer peripheral edge of the nozzle plate 32 as long as it is adhered to the spacer 120 at least outside the nozzle plate 32.

Further, the nozzle guard 33 is adhered to a part of the spacer 120 that is exposed through each of the slits 135 of the nozzle plate 32 (hereinbelow, referred to as a "second adhesion region 151"). That is, the second adhesion region 151 extends parallel to the nozzle arrays 130A to 130D along the X direction. Accordingly, the second adhesion region 151 partitions between nozzle arrays of different colors in the nozzle arrays 130A to 130D (between the second nozzle array 130B and the third nozzle array 130C).

[Printer Operation Method]

Next, a method for recording information on the recording medium P using the printer 1 described above will be described.

As illustrated in FIG. 1, when the printer 1 is actuated, the grid rollers 11, 13 of the conveyance mechanisms 2, 3 rotate. Accordingly, the recording medium P is conveyed in the +X direction between the grid rollers 11, 13 and the pinch rollers 12, 14. Simultaneously, the drive motor 28 rotates the pulley 26 to cause the endless belt 27 to travel. Accordingly, the carriage 23 moves back and forth in the Y direction while being guided by the guide rails 21, 22.

During this operation, in each of the ink jet heads 5A, 5B, drive voltage is applied to the drive electrodes of the head chip 51. This produces thickness-shear deformation in the drive walls 61, which generates pressure waves in ink filled inside the ejection channels 57. The pressure waves increase the internal pressure of the ejection channels 57, so that the ink is ejected through the nozzle holes 131A to 131D. Then, the ink lands on the recording medium P. As a result, various kinds of information are recorded on the recording medium P.

In the present embodiment, for example, in the first head module 30A, the head chip 51 and the drive board 53 are supported on the manifold 52 which includes the ink flow path 71.

According to this configuration, a member which supports the head chip 51 and the drive board 53 and the ink flow path 71 are integrated to the manifold 52 which is disposed at one side in the Y direction with respect to the head chip 51. This makes it possible to downsize the first head module 30A in the Y direction (main-scanning direction) as compared to a conventional configuration in which a member which supports a head chip and a drive board is disposed at one side in the Y direction with respect to the head chip and a member which includes an ink flow path is separately disposed at the other side in the Y direction with respect to the head chip. As a result, it is possible to downsize the ink jet head 5A in the Y direction.

Heat generated in the head chip 51 and the drive board 53 is dissipated to the outside through the manifold 52. This makes it possible to enhance the heat dissipation performance of the head chip 51 and the drive board 53.

Further, since the head chip 51 and the drive board 53 are supported on the manifold 52 which includes the ink flow path 71, ink flowing through the ink flow path 71 can be heated (kept warm) using exhaust heat which is generated in the head chip 51 and the drive board 53 and transmitted to the manifold 52. As a result, it is possible to supply ink having a desired temperature (viscosity) to the head chip 51 and thereby obtain an excellent printing characteristic.

In addition, in the present embodiment, the head modules 30A to 30D can be downsized in the Y direction. Thus, the manifold 52 can be provided in each of the head chips 51. As a result, it is possible to enhance the heat dissipation performance of each of the head chips 51 as compared to a configuration in which a plurality of head chips 51 are mounted on each of the head modules 30A to 30D in order to achieve high-density recording.

In the present embodiment, the damper 31 is disposed in the +Z direction with respect to the manifold 52. Thus, it is possible to downsize the ink jet head 5A in the Y direction as compared to a configuration in which the damper 31 and the manifold 52 are disposed side by side in the Y direction.

In the present embodiment, the ink flow path 71 extends in a meandering manner. Thus, it is possible to increase a heat transfer area between ink and the manifold 52 as compared to a case in which an ink flow path is linearly formed between the communicating part between the meandering portion 79 and the inflow port 76 and the communicating part between the meandering portion 79 and the communication portion 80. Therefore, exhaust heat from the head chip 51 and the drive board 53 and heat of the heater 85 can be effectively transmitted to ink inside the ink flow path 71. Accordingly, it is possible to supply ink having a desired temperature (viscosity) to the head chip 51, which enables the temperature of ink during ejection to be maintained within a desired range. As a result, it is possible to reduce variations in the ejection amount and the ejection speed of ink and thereby obtain an excellent printing characteristic.

In the present embodiment, the heater 85 is disposed on the face facing the +Y direction (the face opposite to the face supporting the drive board 53) of the manifold 52.

According to this configuration, ink flowing through the ink flow path 71 can be heated also by the heater 85 in addition to the exhaust heat from the head chip 51 and the drive board 53. Thus, it is possible to reliably supply ink having a desired temperature to the head chip 51.

In the present embodiment, the drive board 53 is supported on the manifold 52. Thus, as described above, ink can be heated using exhaust heat from the drive board 53. Accordingly, it is possible to reduce power consumption required for heating ink as compared to a case in which ink is heated only by the heater 85.

Further, heat generated in the drive board 53 is effectively dissipated to the manifold 52 and ink flowing through the ink flow path 71. Thus, it is possible to prevent the temperature of the drive board 53 from becoming high.

In the present embodiment, the coating having corrosion resistance is formed on the inner face of the ink flow path 71. Thus, it is possible to reduce corrosion of the manifold 52 caused by ink and thereby improve durability.

In the present embodiment, the insulating sheet 86 is interposed between the head chip 51 and the manifold 52. Thus, a stray capacitance between the head chip 51 and the manifold 52 can be reduced. As a result, it is possible to reduce electrical noises generated when the head chip 51 is driven and enhance the operation reliability of the ink jet head 5A.

Further, the use of a material having ink resistance such as polyimide as the insulating sheet 86 makes it possible to reduce elution of the insulating sheet 86 caused by ink and reduce ejection failures.

Further, the use of a soft material such as polyimide as the insulating sheet 86 makes it possible to relax a stress that acts on the head chip 51 and the manifold 52 due to a difference in thermal expansion coefficient between the head chip 51 and the manifold 52. As a result, for example, it is possible to reduce cracking of the head chip 51 and come-off of the head chip 51 from the manifold 52.

In the present embodiment, the nozzle plate 32 which includes the nozzle arrays 130A to 130D corresponding to the respective head modules 30A to 30D is disposed on the −Z direction end face of the base member 38.

This configuration makes it possible to improve the position accuracy of the nozzle holes 131A to 131D as compared to a configuration in which the nozzle plate 32 is attached to each of the head modules 30A to 30D.

In the present embodiment, the spacer 120 is interposed between the nozzle plate 32 and the base member 38. Thus, it is possible to relax a stress that acts on the nozzle plate 32 and the base member 38 due to a difference in thermal expansion coefficient between the nozzle plate 32 and the base member 38.

Further, in the present embodiment, the spacer 120 is adhered to the base member 38 with the soft adhesive. Thus, it is possible to reliably relax a stress that acts on the spacer 120 and the base member 38 due to a difference in thermal expansion coefficient between the spacer 120 and the base member 38.

As a result, it is possible to reduce come-off of nozzle plate 32 from the head chip 51.

In the present embodiment, the first adhesion region 150 between the nozzle guard 33 and the spacer 120 surrounds the periphery of the nozzle plate 32.

According to this configuration, when ink adhered to the −Z direction end face of the nozzle plate 32 or the nozzle guard 33 tries to enter the inside of the ink jet head 5A through a gap between the nozzle plate 32 and the nozzle guard 33, it is possible to dam up the ink with the first adhesion region 150. As a result, it is possible to prevent ink from entering the inside of the ink jet head 5A.

In the present embodiment, the second adhesion region 151 between the nozzle guard 33 and the spacer 120 is disposed between the nozzle arrays 130B, 130C which eject different colors of ink in the nozzle arrays 130A to 130D.

According to this configuration, the different colors of ink adhered onto the −Z direction end face of the nozzle plate 32 are blocked by the second adhesion region 151. This makes is possible to reduce leakage of a mixture of the different colors of ink to the outside of the ink jet head 5A.

In the present embodiment, the first biasing member and the second biasing members 70 which bias the base member 38 and the head modules 30A to 30D to one side in the X direction and the Y direction are interposed between the base member 38 and the head modules 30A to 30D.

According to this configuration, the head modules 30A to 30D are held on the base member 38 in a state pressed to the one side in the X direction and the Y direction. Thus, it is possible to position the head modules 30A to 30D with respect to the base member 38 with high accuracy. As a result, it is possible to improve assemblability when the head modules 30A to 30D are fixed to the base member 38 through the stays thereafter.

In the present embodiment, the temperature sensor 94 is disposed on the back face of the actuator plate 55. Thus, it is possible to precisely detect the ink temperature in the ejection channels 57 as compared to a case in which the temperature sensor 94 is disposed at a position away from the actuator plate 55.

In particular, in the present embodiment, the heat transfer plate 65 is disposed between the temperature sensor 94 and the actuator plate 55 so as to cover the entire channels 57, 58. Thus, it is possible to detect an average ink temperature in all the ejection channels 57.

The printer 1 of the present embodiment is provided with the ink jet head 5A described above. Thus, it is possible to provide the printer 1 having high reliability while achieving downsizing in the Y direction.

(Second Embodiment)

Figure 9:
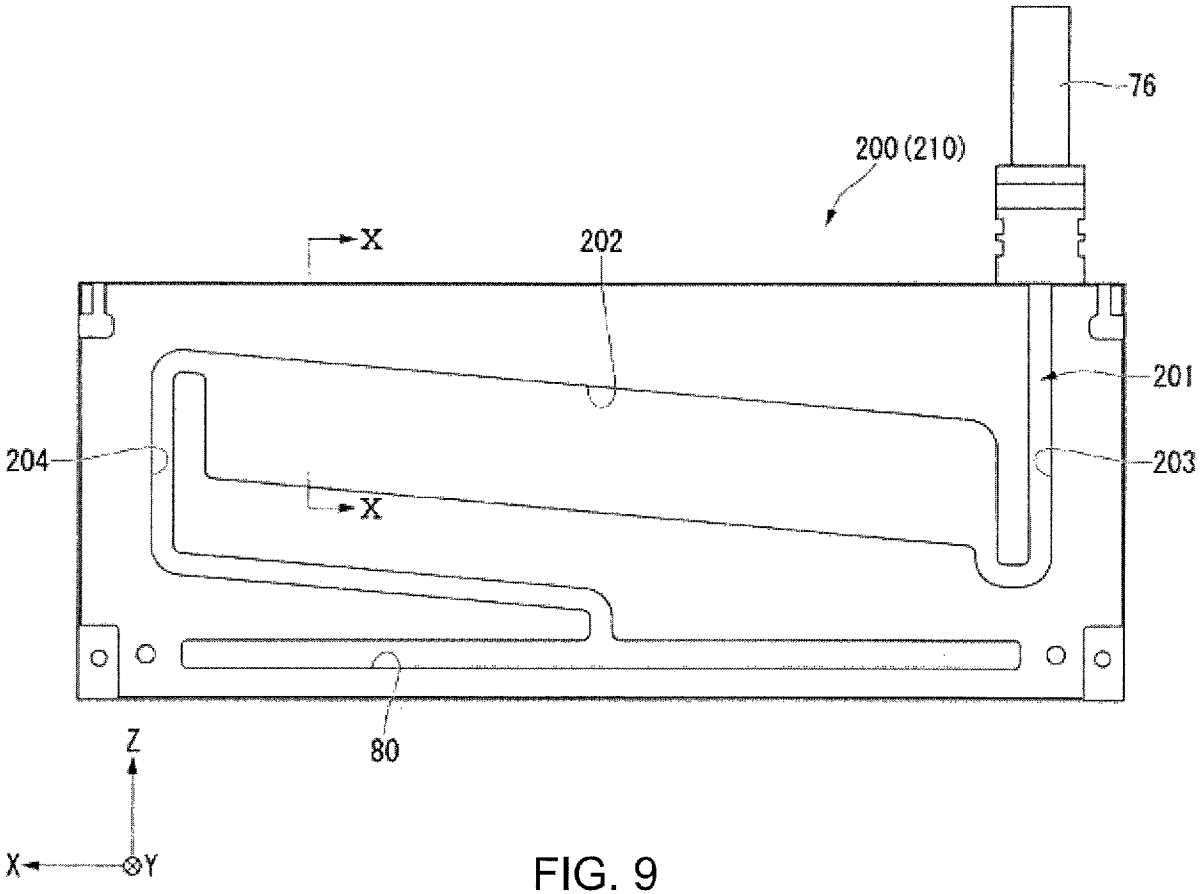
FIG. 9 is a front view of a flow path member according to a second embodiment.

Next, a second embodiment of the present invention will be described. FIG. 9 is a front view of a flow path member 200 according to the second embodiment. The present embodiment differs from the above embodiment in that an ink reservoir 202 for temporarily retaining ink is formed in an ink flow path 201. In the following description, the same configurations as the first embodiment will be designated by the same reference signs as the first embodiment and description thereof will be omitted.

In the flow path member 200 of a manifold 210 illustrated in FIG. 9, the ink flow path 201 extends in such a manner that a part located on the upstream side with respect to the communication portion 80 meanders. Specifically, the ink flow path 201 is provided with the ink reservoir 202, an upstream main flow path 203 which is connected to the upstream side of the ink reservoir 202, and a downstream main flow path 204 which is connected to the downstream side of the ink reservoir 202.

The ink reservoir 202 is formed in a central part (a central part in the X direction and the Z direction) of a face facing the −Y direction of the flow path member 200. The ink reservoir 202 is formed in a parallelogram extending in an inclined manner in the +Z direction toward the +X direction in front view viewed from the Y direction. The capacity of the ink reservoir 202 is larger than the capacity of the upstream main flow path 203 and the downstream main flow path 204. A fin may be formed on the inner face of the ink reservoir 202.

The upstream main flow path 203 is located in the −X direction with respect to the ink reservoir 202 in the flow path member 200. The upstream main flow path 203 extends in the −Z direction from a +Z direction end face of the flow path member 200 and then turns back in the +Z direction (meanders). A downstream end of the upstream main flow path 203 is connected to a −X direction end of the ink reservoir 202 from the −Z direction.

The downstream main flow path 204 is located in the +X direction with respect to the ink reservoir 202 in the flow path member 200. The downstream main flow path 204 extends in the −Z direction and then bends in the −X direction (meanders). An upstream end of the downstream main flow path 204 is connected to a +Z direction end of the ink reservoir 202 from the +X direction. That is, the upstream end of the downstream main flow path 204 is connected to the ink reservoir 202 at a diagonal position with respect to a connection part between the upstream main flow path 203 and the ink reservoir 202. A downstream end of the downstream main flow path 204 is connected to the communication portion 80. For example, the flow path cover 73 (refer to FIG. 6) is fixed to a face facing the −Y direction of the flow path member 200 in the same manner as the above embodiment. Accordingly, the ink flow path 201 is blocked.

In the present embodiment, ink flowing into the upstream main flow path 203 flows through the upstream main flow path 203 in the −Z direction, then turns back in the +Z direction, and flows into the ink reservoir 202. The ink flowing into the ink reservoir 202 temporarily stays in the ink reservoir 202, and then flows into the downstream main flow path 204 from the +Z direction end of the ink reservoir 202. The ink flowing into the downstream main flow path 204 flows into the communication portion 80 at the downstream end. Then, the ink flowing into the communication portion 80 is supplied to the head chip 51 in the same manner as the above embodiment.

In the present embodiment, ink flowing through the ink flow path 201 is temporarily retained in the ink reservoir 202. Thus, a sufficient time for heating ink can be ensured. Accordingly, it is possible to supply ink having a desired temperature (viscosity) to the head chip 51, which enables the temperature of ink during ejection to be maintained within a desired range. As a result, it is possible to reduce variations in the ejection amount and the ejection speed of ink and thereby obtain an excellent printing characteristic.

Figure 10:
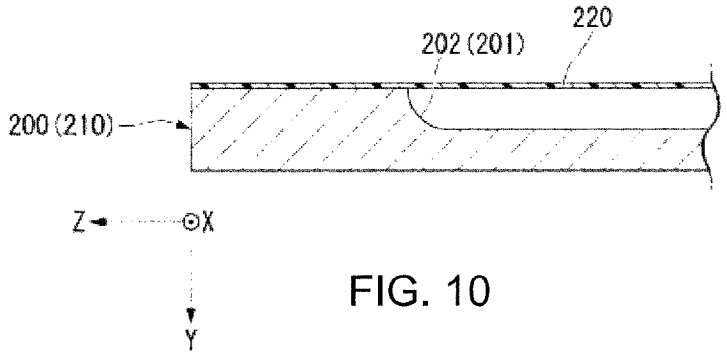
FIG. 10 is a sectional view taken along line X-X of FIG. 9.

As illustrated in FIG. 10, a material having flexibility may be employed as the flow path cover 220, and a flat spring (not illustrated) which is elastically deformable in the Y direction may be disposed inside the ink reservoir 202. According to this configuration, the flow path cover 220 is flexurally deformed in response to pressure fluctuations inside the ink reservoir 202, which makes it possible to absorb pressure fluctuations of ink supplied to the ink reservoir 202. A filter may be disposed in a part located near the head chip 51 in the ink flow path 201 (e.g., the downstream main flow path 204).

Adding a damper function or a filter function to the inside of the manifold 52 (the head modules 30A to 30D themselves) in this manner eliminates the necessity of separately providing a damper or a filter. Thus, it is possible to achieve further downsizing and simplification.

Figure 11:
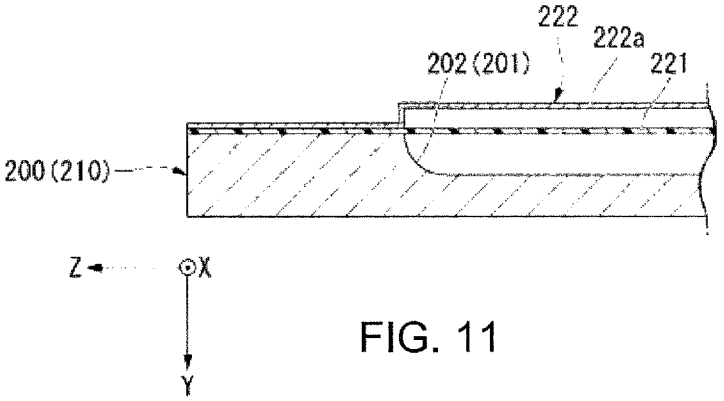
FIG. 11 is a sectional view taken along line X-X of FIG. 9.

As illustrated in FIG. 11, the flow path cover may include an inner cover 221 having flexibility and an outer cover 222 which covers the inner cover 221 from the −Y direction. The outer cover 222 is formed of a material (e.g., a metal material) having a higher stiffness than the inner cover 221. The outer cover 222 includes a projection 222*a* which is formed in a part covering the ink reservoir 202 and projects in the −Y direction. The projection 222*a* receives the inner cover 221 when the inner cover 221 is flexurally deformed in the −Y direction.

In the configuration illustrated in FIG. 11, the inner cover 221 can be protected by the outer cover 222. Thus, it is possible to improve durability.

(Third Embodiment)

Figure 12:
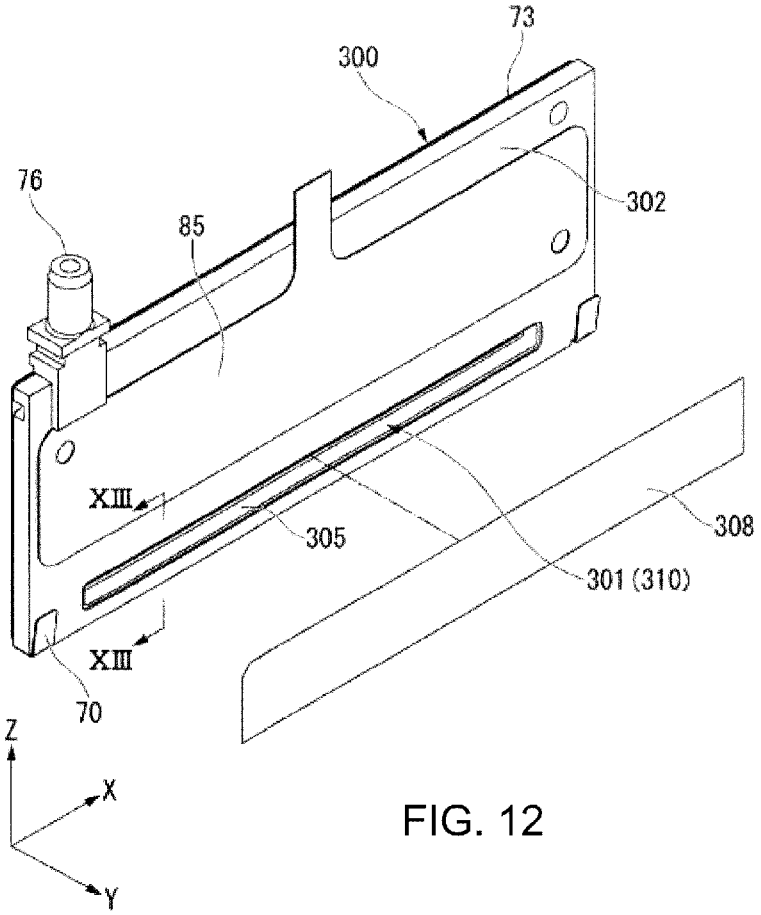
FIG. 12 is a perspective view of a manifold according to a third embodiment.

Next, a third embodiment of the present invention will be described. FIG. 12 is a perspective view of a manifold 300 according to the third embodiment. The third embodiment differs from the above embodiments in that a flow path member 302 includes a communication opening 305 which is formed in a communicating part between the ink flow path 301 and the head chip 51 (the common ink chamber 62) and penetrates the flow path member 302. In the following description, the same configurations as the above embodiments will be designated by the same reference signs as the above embodiments and description thereof will be omitted.

In the manifold 300 illustrated in FIG. 12, the flow path member 302 includes the communication opening 305 which penetrates the flow path member 302 in the Y direction. The communication opening 305 is formed on the flow path member 302 at a position overlapping the common ink chamber 62 in front view viewed from the Y direction. The communication opening 305 communicates with the common ink chamber 62 through the communication hole 82 (refer to FIG. 13) of the flow path cover 73 in the −Y direction with respect to the manifold 300.

Figure 13:
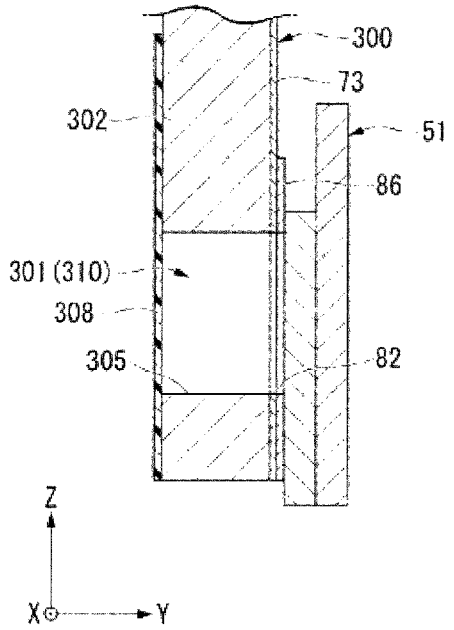
FIG. 13 is a sectional view taken along line XIII-XIII of FIG. 12.

FIG. 13 is a sectional view taken along line XIII-XIII of FIG. 12.

As illustrated in FIGS. 12 and 13, a film member 308 which blocks the communication opening 305 is disposed on a face facing the +Y direction of the flow path member 302. The film member 308 is formed of a material having flexibility (e.g., a resin material). The film member 308 is fixed to the flow path member 302 with, for example, an adhesive. A part defined by the inner face of the communication opening 305 and the film member 308 constitutes a communication portion 310 which communicates with the common ink chamber 62 in the ink flow path 301.

In the present embodiment, a part of the inner face of the communication portion 310 is formed of the film member 308 having flexibility. Thus, the film member 308 is flexurally deformed in response to pressure fluctuations inside the head chip 51. This makes it possible to absorb the pressure fluctuations inside the head chip 51. For example, the pressure inside the ejection channels 57 is momentarily reduced by a reduction in the capacity of the ejection channels 57 caused by ink ejection. Accordingly, the pressure fluctuations inside the ejection channels 57 are transmitted to the communication portion 310 as pressure waves, and the film member 308 is flexurally deformed. That is, the film member 308 is flexurally deformed so as to reduce the capacity of the communication portion 310. Accordingly, the pressure fluctuations which occur inside the ejection channels 57 can be absorbed by the communication portion 310. Further, it is also possible to reduce crosstalk (a phenomenon in which pressure fluctuations in one ejection channel 57 are transmitted to another ejection channel 57 through the common ink chamber 62 and the communication opening 305) by absorbing the pressure fluctuations by the film member 308. As a result, the printing characteristic can be improved.

In particular, in the present embodiment, the film member 308 is disposed at the position that faces the head chip 51 in the Y direction with the flow path member 302 interposed therebetween. Thus, pressure waves transmitted from the ejection channels 57 are easily transmitted to the film member 308. Thus, it is possible to effectively exhibit the above pressure absorbing effect.

In the present embodiment, the communication opening 305 penetrates the flow path member 302 in the Y direction. Thus, it is possible to easily ensure a sufficient capacity of the communication portion 310 while downsizing the manifold 300 in the Y direction as compared to a case in which a communication portion is formed in a groove shape. Ensuring a sufficient capacity of the communication portion 310 makes it easy to absorb pressure fluctuations in the head chip 51 inside the communication portion 310. Thus, it is possible to reduce the crosstalk described above.

In the above embodiment, the film member 308 has flexibility. However, the present invention is not limited only to this configuration. For example, a metal plate may be employed as the film member 308. Also in this configuration, it is possible to reduce the crosstalk by ensuring a sufficient capacity of the communication portion 310.

(Fourth Embodiment)

Figure 14:
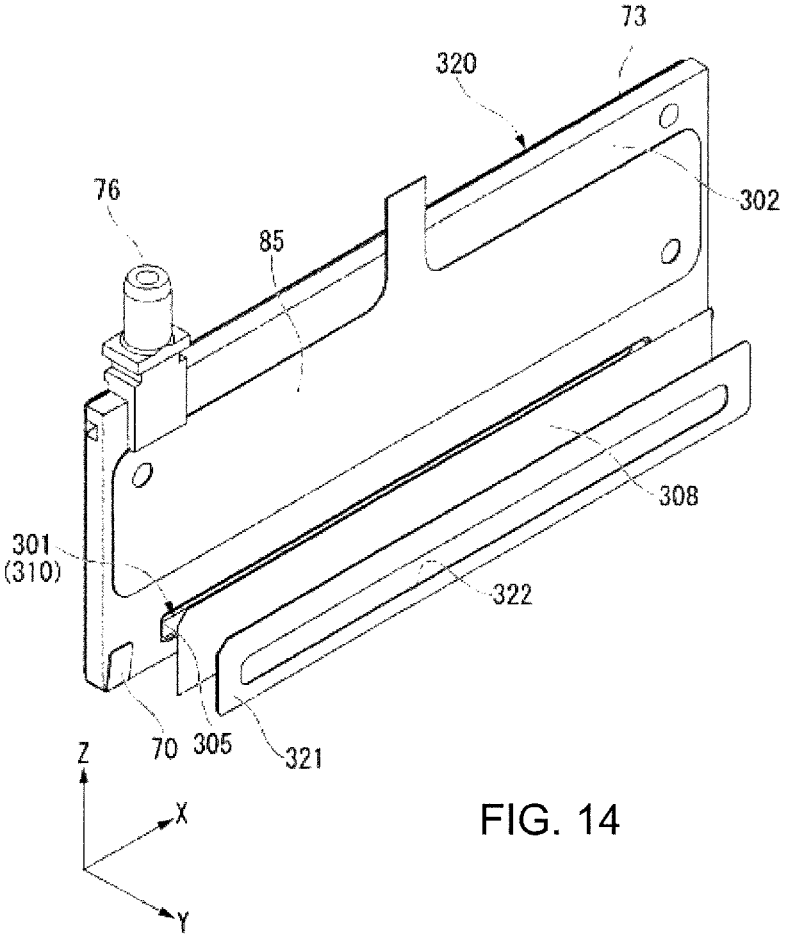
FIG. 14 is a perspective view of a manifold according to a fourth embodiment.
Figure 15:
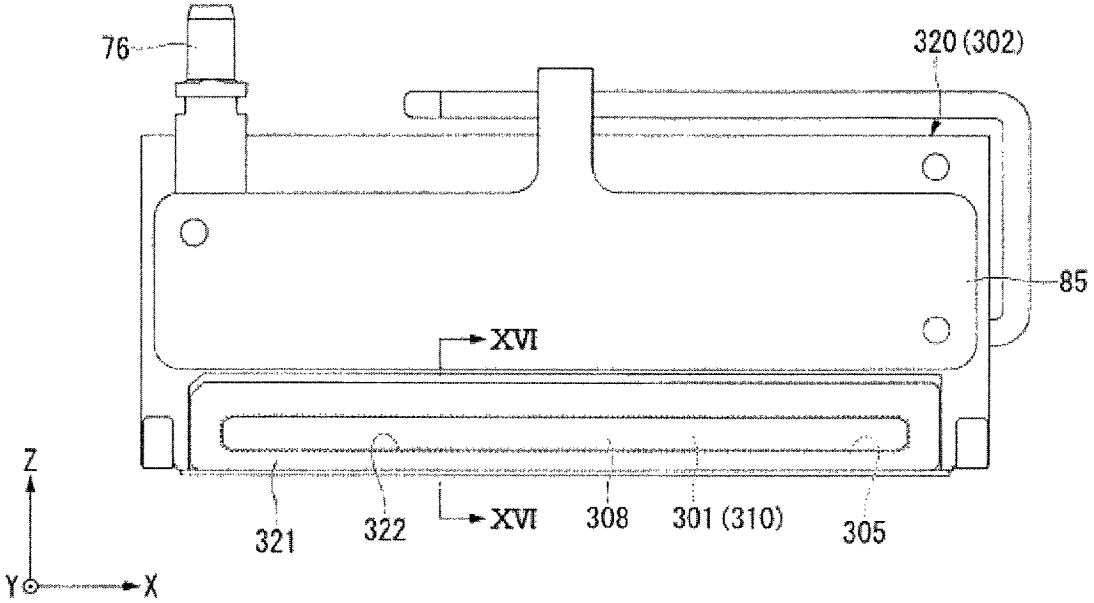
FIG. 15 is a front view of the manifold according to the fourth embodiment viewed from a +Y direction.

Next, a fourth embodiment of the present invention will be described. FIG. 14 is a perspective view of a manifold 320 according to the fourth embodiment. FIG. 15 is a front view of the manifold 320 according to the fourth embodiment viewed from the +Y direction. The present embodiment differs from the above embodiments in that a film holder 321 which holds the film member 308 is provided.

In the manifold 320 illustrated in FIGS. 14 and 15, the film member 308 is formed of a material having flexibility.

The film holder 321 is disposed on a face facing the +Y direction of the film member 308. The film holder 321 holds the film member 308 in the Y direction between the film holder 321 and the flow path member 302. The film holder 321 is formed of a material (e.g., a metal material) harder than the film member 308 and has a thin plate-like shape. The film holder 321 of the present embodiment has the same outer shape as the film member 308 in front view viewed from the Y direction. The film holder 321 is fixed to the film member 308 and the flow path member 302 with, for example, an adhesive.

As illustrated in FIG. 15, the film holder 321 includes a clearance hole 322 which is formed at a position overlapping the communication opening 305 in the Y direction and penetrates the film holder 321 in the Y direction. The clearance hole 322 is provided for preventing interference between the film member 308 and the film holder 321 when the film member 308 is flexurally deformed. That is, the film member 308 can enter the inside of the clearance hole 322 when flexurally deformed. In front view viewed from the Y direction, an opening area of the clearance hole 322 is preferably equal to or larger than an opening area of the communication opening 305. The opening area of the clearance hole 322 may be smaller than the opening area of the communication opening 305.

Figure 16:
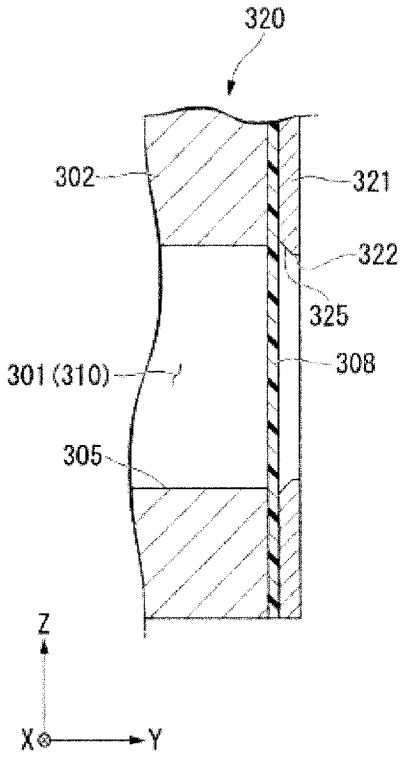
FIG. 16 is a sectional view taken along line XVI-XVI of FIG. 15.

FIG. 16 is a sectional view taken along line XVI-XVI of FIG. 15.

As illustrated in FIG. 16, the clearance hole 322 includes a chamfered portion 325 which is formed on an opening edge located in the −Y direction. The chamfered portion 325 is, for example, a flat chamfered portion. The chamfered portion 325 may be a round chamfered portion or a sag surface formed during processing of the clearance hole 322.

In the present embodiment, it is possible to reduce come-off of the film member 308 and thereby improve durability by holding the film member 308 in the Y direction between the film holder 321 and the flow path member 302.

Further, the clearance hole 322 includes the chamfered portion 325 which is formed on the opening edge located in the −Y direction. Thus, it is possible to reduce interference between the film member 308 and the corner of the film holder 321 when the film member 308 is flexurally deformed. As a result, it is possible to reduce damage of the film member 308 and thereby improve durability.

Figure 17:
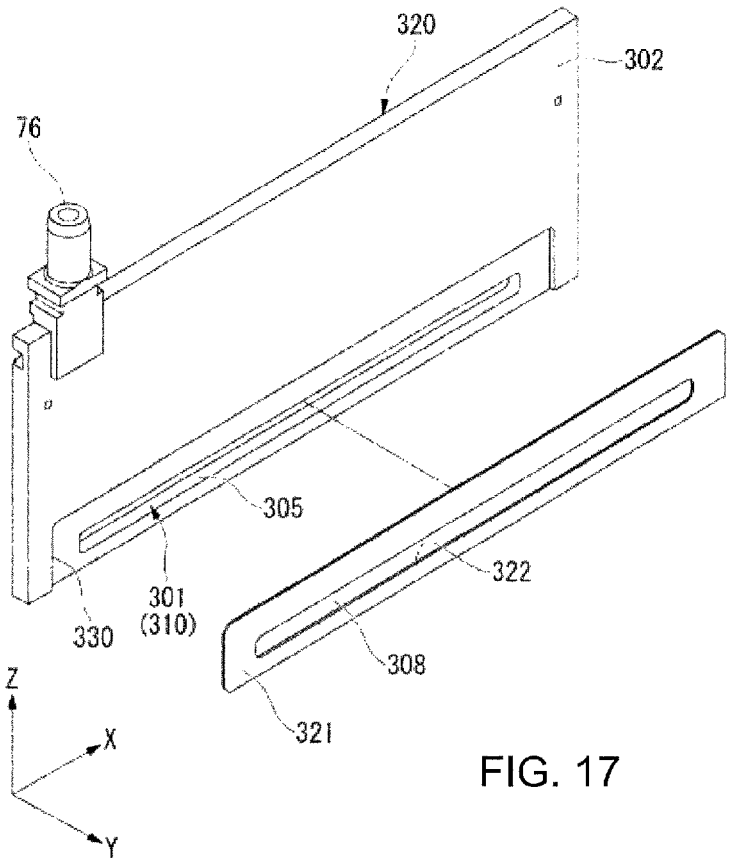
FIG. 17 is a perspective view of a manifold according to a modification of the embodiment.

For example, as illustrated in FIG. 17, the flow path member 302 may include a housing recess 330 which houses the film member 308 and the film holder 321. The housing recess 330 is recessed in the −Y direction from a face facing the +Y direction of the flow path member 302. The housing recess 330 is larger than the outer shapes of the film member 308 and the film holder 321 in front view and surrounds the periphery of the communication opening 305. A recessed amount of the housing recess 330 in the Y direction may be any thickness capable of housing at least the film member 308 (larger than the thickness of the film member 308). For example, the recessed amount of the housing recess 330 in the Y direction may be equal to or larger than the sum of the thickness of the film member 308 and the thickness of the film holder 321.

According to this configuration, since the housing recess 330 is formed on the flow path member 302, the housing recess 330 can be used as a guide which is used when the film member 308 and the film holder 321 are attached to the flow path member 302. This makes it possible to improve the positioning accuracy and the assembling efficiency of the film member 308 and the film holder 321.

Further, it is possible to reduce a projecting amount of the film member 308 and the film holder 321 from the face facing the +Y direction of the flow path member 302. Thus, the manifold 320 can be downsized in the Y direction.

The film member 308 and the film holder 321 may be attached to the flow path member 302 in a sequential order. Alternatively, the film member 308 and the film holder 321 may be previously assembled as a film assembly, and the film assembly may be attached to the flow path member 302 thereafter.

Attaching the film assembly to the flow path member 302 makes it possible to improve the handleability as compared to a case in which the film member 308 and the film holder 321 are attached to the flow path member 302 in a sequential order. Unlike the case in which the film member 308 and the film holder 321 are attached to the flow path member 302 in a sequential order, it is possible to reduce the entry of an adhesive which fixes the film member 308 and the film holder 321 into the clearance hole 322. As a result, it is possible to reduce obstruction to flexural deformation of the film member 308 by the adhesive.

The technical scope of the present invention is not limited to the above embodiment, and various modifications can be added without departing from the gist of the invention.

For example, in the above embodiment, the ink jet printer 1 has been described as an example of the liquid jet apparatus. However, the liquid jet apparatus is not limited to a printer. For example, the liquid jet apparatus may be a fax machine or an on-demand printing machine.

In the above embodiment, the four head modules 30A to 30D are mounted on the base member 38. However, the present invention is not limited only to this configuration. The number of head modules mounted on the base member 38 may be one or more.

In the above embodiment, each two of the head modules eject one color of ink. However, the present invention is not limited only to this configuration. Three or more head modules may eject one color of ink, or one head module may eject one color of ink.

In the above embodiment, the edge shoot type head chip has been described. However, the present invention is not limited thereto. For example, the present invention may be applied to a side shoot type head chip which ejects ink from a central part in an extending direction of an ejection channel.

Further, the present invention may be applied to a roof shoot type head chip in which the direction of pressure applied to ink and an ejection direction of ink droplets are equal.

In the above embodiments, the head chip 51 and the drive board 53 are supported on the same face of the manifold 52. However, the present invention is not limited only to this configuration. The head chip 51 and a heating mechanism (the drive board 53 and the heater 85) may be supported on different faces of the manifold 52.

In the above embodiments, both the drive board 53 and the heater 85 are supported on the manifold 52. However, the present invention is not limited only to this configuration. It is only required that at least either the drive board 53 or the heater 85 be supported on the manifold 52.

In addition to the above, an element in the above embodiment can be appropriately replaced with a known element, or the above modifications may be appropriately combined without departing from the gist of the invention.

(1) A liquid jet head includes: a jet hole plate including a jet hole array, the jet hole array including a plurality of jet holes each extending in a first direction, the jet holes being arranged side by side in a second direction perpendicular to the first direction; a head chip disposed at one side in the first direction with respect to the jet hole plate and including channels communicating with the respective jet holes; a manifold disposed at one side in a third direction perpendicular to the first direction and the second direction with respect to the head chip, the manifold being configured to support the head chip by a first face facing the third direction and including a liquid flow path communicating with the channels; and a drive board supported on the first face of the manifold and electrically connected to the head chip.

(2) The liquid jet head further includes a damper configured to absorb pressure fluctuations of liquid supplied to the liquid flow path, the damper being disposed at a side opposite to the jet hole plate in the first direction with respect to the manifold and connected to the liquid flow path.

(3) The liquid jet head further includes a heater disposed on a second face facing the third direction of the manifold.

(4) The liquid jet head further includes an insulating sheet interposed between the first face of the manifold and a face of the head chip, the face facing the third direction and facing the first face of the manifold.

(5) In the liquid jet head, the head chip, the manifold and the drive board constitute a head module, a plurality of the head modules are mounted side by side in the third direction on a base member, and the jet hole plate includes a plurality of the jet hole arrays corresponding to the head chips of the head modules and is disposed on a plate placement face of the base member, the plate placement face facing the other side in the first direction.

(6) The liquid jet head further includes a spacer interposed between the plate placement face of the base member and a face of the jet hole plate, the face facing the first direction and facing the plate placement face of the base member.

(7) In the liquid jet head, the spacer is adhered to the base member with a soft adhesive, and the jet hole plate is adhered to the spacer with a hard adhesive formed of a material harder than the soft adhesive.

(8) The liquid jet head further includes a jet hole guard configured to cover the jet hole plate from the other side in the first direction, the jet hole guard including an exposure hole configured to expose the jet hole array to the outside and being disposed on the other side in the first direction with respect to the jet hole plate, the jet hole plate is smaller than the outer shape of the spacer in plan view viewed from the first direction, the jet hold guard is adhered to the spacer in a region outside the jet hole plate in plan view viewed from the first direction, and an adhered part between the jet hole guard and the spacer surrounds the periphery of the jet hole plate.

(9) In the liquid jet head, a plurality of the head modules include a first head module capable of ejecting a first liquid and a second head module capable of ejecting a second liquid having a different color from the first liquid, the jet hole plate includes a slit formed in a part between a first jet hole array corresponding to the first head module and a second jet hole array corresponding to the second head module, the slit penetrating the jet hole plate in the first direction and being configured to partition between the first jet hole array and the second jet hole array, and the jet hole guard is adhered to the spacer through the slit.

(10) In the liquid jet head, the base member includes an attachment opening that penetrates the base member in the first direction and inserts the head module therein, and a biasing member configured to bias the head module and the base member in at least either the second direction or the third direction is interposed between the head module and the base member.

What is claimed is:

1. A liquid jet head comprising:

a head chip including a plurality of channels formed in the head chip and filled with liquid;

a manifold provided separately from the head chip and configured to support the head chip, the manifold including a liquid flow path formed in the manifold to communicate with the plurality of channels and deliver the liquid to the plurality of channels, wherein the liquid flow path extends in the manifold in a meandering manner; and a heating mechanism configured to heat liquid inside the liquid flow path, the heating mechanism being supported on the manifold.

2. The liquid jet head according to claim 1, wherein the heating mechanism is a heater.

3. The liquid jet head according to claim 1, wherein the heating mechanism is a drive board electrically connected to the head chip.

4. The liquid jet head according to claim 1, wherein a coating having corrosion resistance to the liquid is formed at least on an inner face of the liquid flow path in the manifold.

5. The liquid jet head according to claim 1, wherein the liquid flow path includes:

a main flow path; and a liquid reservoir configured to retain the liquid inside thereof, the liquid reservoir communicating with the main flow path.

6. The liquid jet head according to claim 1, wherein the manifold includes a flow path member including a first face configured to support the head chip, the liquid flow path includes a communication opening that penetrates the flow path member to communicate with the plurality of channels, and the communication opening is blocked by a film member disposed on a second face of the flow path member opposite to the first face thereof in a normal direction of the first face.

7. The liquid jet head according to claim 6, wherein the film member has flexibility.

8. The liquid jet head according to claim 7, wherein the manifold includes a film holder configured to hold the film member in the normal direction between the film holder and the flow path member.

9. The liquid jet head according to claim 8, wherein the film holder includes a clearance hole configured to accommodate flexural deformation of the film member, the clearance hole being formed at a position co-located with the communication opening in the normal direction, and the clearance hole is provided with a chamfered opening edge facing the film member in the normal direction.

10. The liquid jet head according to claim 8, wherein the second face of the flow path member includes a housing recess configured to house the film member and the film holder, the housing recess being recessed in the flow path member in the normal direction.

11. A liquid jet apparatus comprising the liquid jet head according to claim 1.

* * * * *